US005706772A

United States Patent [19]

Hara

[11] Patent Number: 5,706,772

[45] Date of Patent: Jan. 13, 1998

[54] TAPPET IN AN INTERNAL COMBUSTION ENGINE AND A METHOD OF MANUFACTURING THE TAPPET

[75] Inventor: Nobuo Hara, Fujisawa, Japan

[73] Assignee: Fuji Oozx Incorporated, Japan

[21] Appl. No.: 743,031

[22] Filed: Nov. 4, 1996

[51] Int. Cl.[6] ..... F01L 1/14

[52] U.S. Cl. ..... 123/90.48; 123/90.52; 74/569

[58] Field of Search ..... 123/90.48, 90.49, 123/90.51, 90.52; 74/569

[56] References Cited

U.S. PATENT DOCUMENTS

| | | | |
|---|---|---|---|
| 1,649,409 | 11/1927 | Jardine | 123/90.51 |
| 3,675,631 | 7/1972 | Hixson | 123/90.52 |
| 5,284,112 | 2/1994 | Takehara et al. | 123/90.48 |
| 5,445,119 | 8/1995 | Regueiro | 123/90.48 |

FOREIGN PATENT DOCUMENTS

| | | | |
|---|---|---|---|
| 0592908A | 4/1994 | European Pat. Off. . | |
| 1020632 | 2/1953 | France | 123/90.51 |
| 3920799 | 1/1991 | Germany | 123/90.48 |
| 2-040008A | 2/1990 | Japan . | |
| 4-246210 | 9/1992 | Japan . | |

*Primary Examiner*—Weilun Lo
*Attorney, Agent, or Firm*—Hoffman, Wasson & Gitler

[57] ABSTRACT

Light metal tappets have been widely used in an internal combustion engine instead of conventional steel tappets. On the upper surface of a top wall of a body, a wear resistant cam receiving plate is put, and a projection of the cam receiving plate is engaged in a groove of the top wall, so that the cam receiving plate is integrally connected with the body, thereby making the tappet smaller and lighter.

1 Claim, 4 Drawing Sheets

TAPPET IN AN INTERNAL COMBUSTION ENGINE AND A METHOD OF MANUFACTURING THE TAPPET

BACKGROUND OF THE INVENTION

The present invention relates to a tappet in an internal combustion engine, a body of the tappet being made of light metal such as Al alloy, and especially to a tappet in an internal combustion engine and a method of manufacturing the tappet, wear resistant material being attached to a contact surface with a rotary cam.

To lighten a direct acting type valve operating mechanism in an internal combustion engine, Al alloy tappets have been widely used instead of conventional steel tappets. Such an Al alloy tappet has lower strength and wear resistance than a steel tappet, and therefore, a wear resistant cam receiving plate is usually attached on the upper surface of the tappet which contacts a rotary cam.

FIG. 6 illustrates a conventional Al alloy tappet 206, and a cylindrical body 208 the upper end of which is closed by a top wall 222 is made of Al alloy. On the upper surface of the top wall 222, there is provided a wear resistant metal cam receiving plate 210 in which the outer diameter is slightly smaller than that of the body 208. The cam receiving plate 210 is fixed on the top wall 222 by inwardly caulking an annular projection 260 which projects upward of the outer circumferential edge of the upper end of the body 208. 202 denotes a rotary cam which contacts the upper surface of the cam receiving plate 210.

The cam receiving plate 210 moves, following movement of the cam 202. Therefore, it is necessary to make an outer diameter of the tappet 206 larger than a rotation track "R" of a nose 262 of the cam.

In the conventional tappet, on the outer circumferential edge of the cam receiving plate 210, there is formed an annular projection 260 which projects upwards and which is caulked inwards. The projection 260 must be outside of the rotation track "R" of the nose 262 of the cam, so that the outer diameter of the body 208 becomes larger.

Increase in outer diameter of the body is not only against lightening of the tappet, but also involves increase in volume of the cylinder head, which is disadvantageous.

Furthermore, variation in caulking force and decrease in caulking force owing to long use decrease holding force of the cam receiving plate 210, so that relative rotation between the cam receiving plate 210 and the body 208 occurs to cause wear on the contact surface. In the cam receiving plate 210 which is merely put and fixed by caulking, it decreases strength of the cam receiving plate which is always subjected to large load.

SUMMARY OF THE INVENTION

The object of the present invention is to provide a tappet in an internal combustion engine and a method of manufacturing the tappet to improve attachment of a cam receiving plate on a body of the tappet, thereby increasing connecting strength between the cam receiving plate and the body to make the body smaller and lighter.

According to one aspect of the present invention, there is provided a tappet in an internal combustion engine, the tappet comprising:

a cylindrical body made of light metal, an upper end of the body being closed by a top wall which has a groove on the upper surface; and a wear resistant cam receiving plate which has roughly equal diameter to the body, the lower surface of the cam receiving plate having a projection which is engaged in the groove of the top wall to connect the cam receiving plate with the top wall integrally.

Compared with a conventional tappet in which the cam receiving plate is fixed by caulking a circumferential projection, an outer diameter of a body can become smaller, thereby making the tappet lighter and smaller.

The projection of the cam receiving plate is annular, the annular projection of the cam receiving plate being formed at a position where the maximum acceleration occurs when the cam receiving plate is pressed by the rotary cam. Therefore, the annular projection effectively functions as a reinforment rib, thereby increasing strength and wear resistance of the cam receiving plate.

According to another aspect of the present invention, there is provided a method of manufacturing a tappet in an internal combustion engine, the method comprising the steps of:

putting a wear resistant cam receiving plate which has a projection on the lower surface, on the upper surface of a flat top wall of a cylindrical intemediate material which has roughly the same form as a light metal body of the tappet to be manufactured, the cam receiving plate having roughly equal diameter to an outer diameter of the intermediate material; and pressing the intermediate material and the cam receiving plate strongly so that the projection gets into the top wall of the intermediate material so as to connect the cam receiving plate with the intermediate material integrally.

By the method according to the present invention, the step for forming a groove on the body can be omitted, and the cam receiving plate can be strongly fixed on the body.

According to further aspect of the present invention, there is provided a method of manufacturing a tappet in an internal combustion engine, the method comprising the steps of:

putting a wear resistant cam receiving plate which has a projection on the lower surface, on the upper surface of a material made of light metal, and forging the cam receiving plate and the material in a die to mold a body of the tappet and to connect the cam receiving plate with the body at the same time.

The body is molded together with connecting to the cam receiving plate, thereby simplifying manufacturing steps and avoiding machining of the projection and groove which require high accuracy to decrease cost.

BRIEF DESCRPITION OF THE DRAWINGS

The features and advantages of the present invention will become more apparent from the following description of embodiments with respect to the accompanying drawings wherein.

DETAILED DESCRIPTION OF PREFERRED EMBODIMENTS

One embodiment of the present invention will be described with respect to FIGS. 1 to 3.

Figure 1:
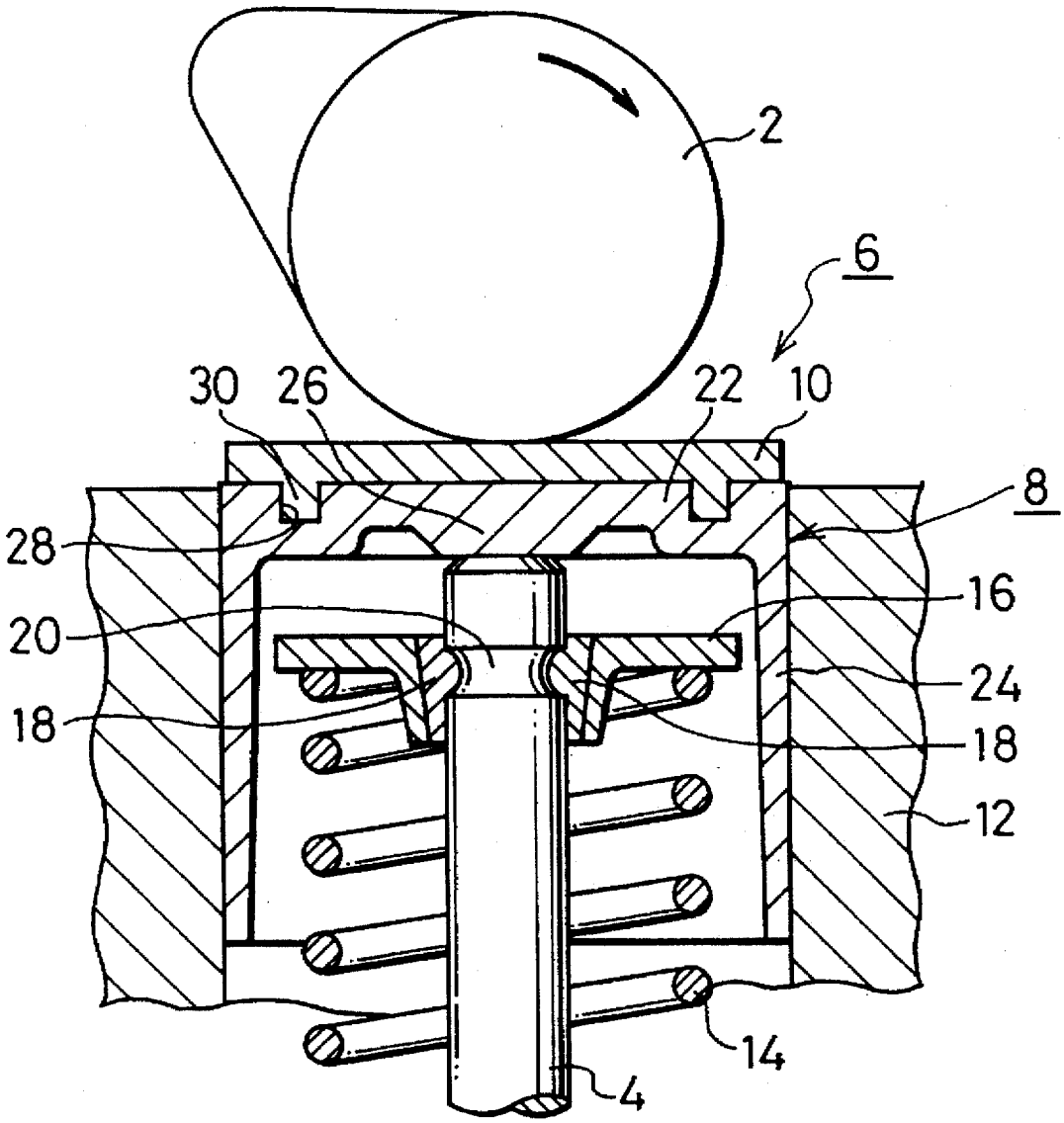
FIG. 1 is a central vertical sectioned front view of a direct acting type valve operating mechanism which contains a tappet according to the present invention.

FIG. 1 is a sectional view of a direct acting type valve operating mechanism which contains a tappet according to the present invention. The numeral 2 denotes a rotary cam which rotates with a crankshaft(not shown). 4 denotes a valve stem of an intake/exhaust valve. 6 denotes a tappet which follows the rotary cam 2 and reciprocates vertically to transmit its movement to the valve stem of the intake/exhaust valve 4. 12 denotes a cylinder head for guiding reciprocating movement of the tappet 6.

The numeral 14 denotes a valve spring for energizing the intake/exhaust valve in a closing direction (upwards in FIG. 1). 18 denotes a spring retainer for transmitting force of the valve spring 14 to the intake/exhaust valve. 18 denotes a pair of cotters which are engaged in an annular groove 20 around the valve stem 4 to mount the spring retainer 18 on the valve stem 4.

The tappet 6 comprises an Al alloy body 8 closed by a top wall 22 of a cylindrical portion 24, and a wear resistant steel cam receiving plate 10 which has a diameter equal to the outer diameter of the body 8. An annular projection 30 on the lower surface of the cam receiving plate 10 is engaged in an annular groove 28 on the top wall 22 concentric with an axis of the body 8, thereby integrally connecting the body 8 with the cam receiving plate 10. An engagement portion 26 which is engaged on the valve stem 4 is thicker than the other of the top wall 22.

Figure 2:
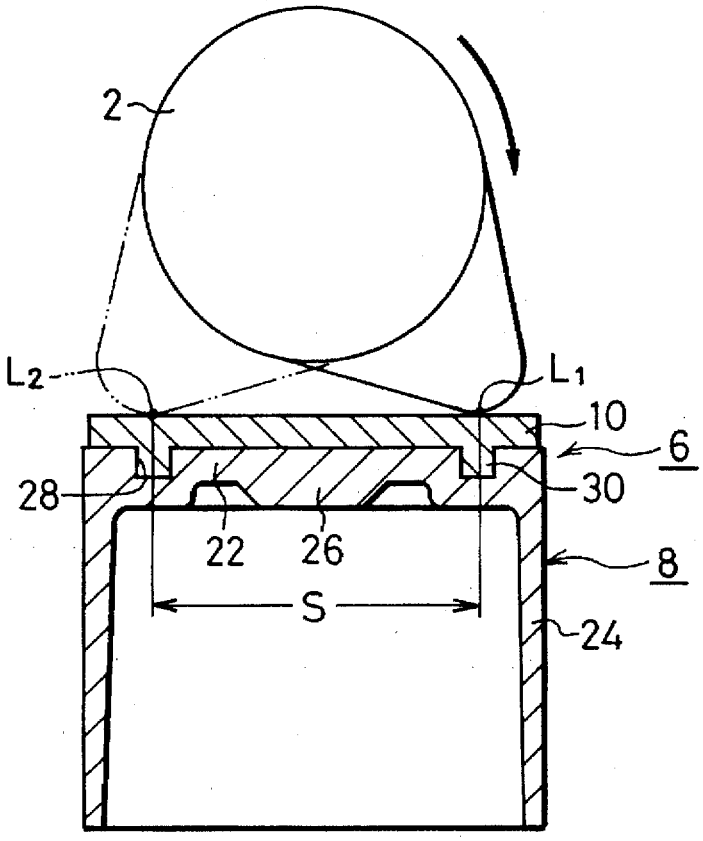
FIG. 2 is a view which shows a relationship between a position where the maximum acceleration occurs and a projection when a tappet is driven by a rotary cam.
Figure 3:
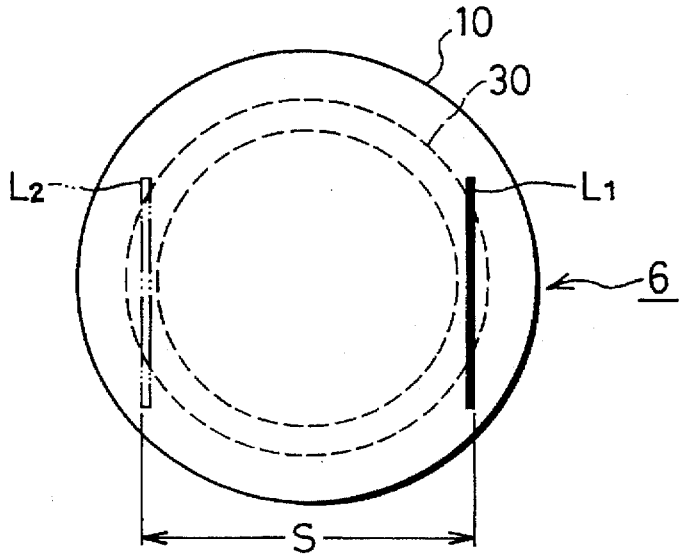
FIG. 3 is a plan view of the tappet.

As shown in FIGS. 2 and 3, the annular projection of the lower surface of the cam receiving plate 10 may be preferably formed at a position where maximum acceleration occurs when the cam receiving plate 10 is pressed by the rotary cam 2. The position where the maximum acceleration occurs can be found by a valve-lift curve obtained by a profile of the rotary cam 2, and is equal to outermost linear contact portions $L_1$ and $L_2$ of a sliding area of the rotary cam 2 on the cam receiving plate 10. The position where the maximum acceleration occurs requires high strength since it is subjected to large force or deviate load by the rotary cam 2, and the annular projection 30 is effectively functioned as a reinforcement rib.

The tappet 6 is usually rotated around an axis of the valve little by little during operation. The annular projection 30 is ring-like, so that it is always subjected to the maximum acceleration regardless of rotation of the tappet 6.

In the tappet of the foregoing embodiment, the cam receiving plate 10 is not held by conventional caulking, so that the outer diameters of the body 8 and the cam receiving plate 10 can be at minimum, thereby making the tappet 6 smaller and lighter.

FIG. 4 illustrates one embodiment of a method of forming a tappet according to the present invention.

Figure 4A:
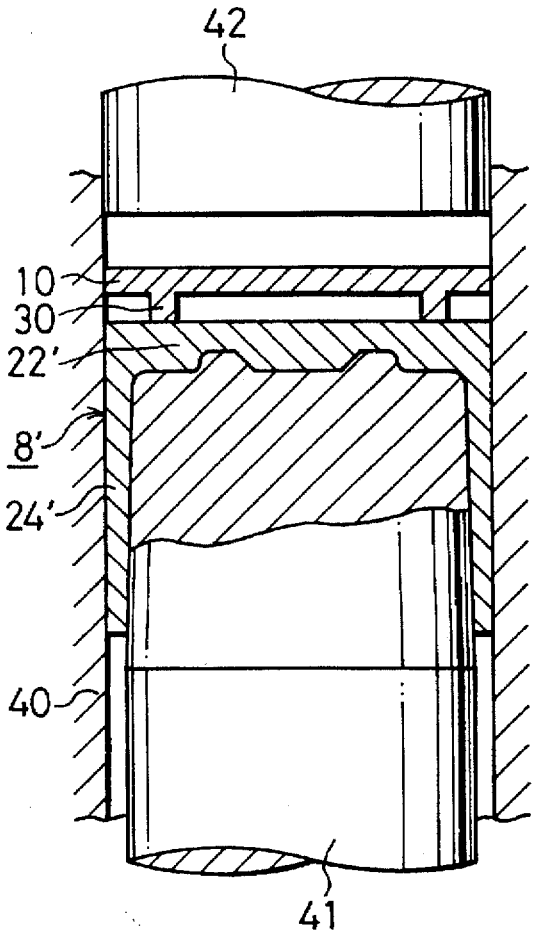
FIG. 4 shows a method according to the present invention in order of the steps, "A" being before pressing, "B" being after pressing.

As shown in FIG. 4(A), an intermediate material 8' having roughly the same as a body 8 of a tappet 6 to be manufactured is molded to have a flat upper surface of a top wall 22'. The intermediate material 8' is put on a lower punch 41 which fits the inner surface of the intermediate material 8' in a die 40 to engage a cylindrical portion 24' with the lower punch 41, and then, the cam receiving plate 10 which has an annular projection 30 on the lower surface is put on the upper surface of a top wall 22'.

Figure 4B:
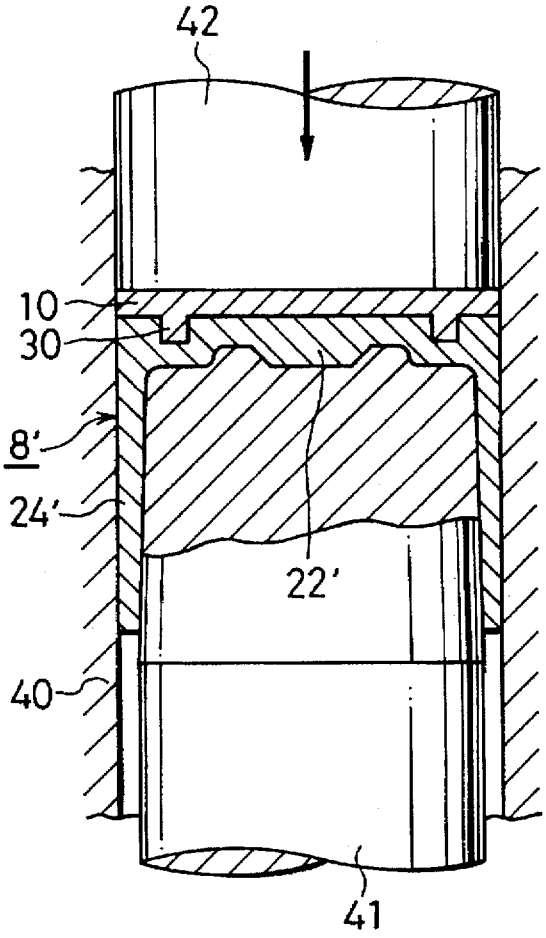

Then, as shown in FIG. 4(B), an upper punch moves down or both of the upper and lower punches 41 and 42 are moved simultaneously, so that the cam receiving plate 10 is strongly pressed. Thus, a portion of the top wall 22' which is engaged on the annular projection 30 is plastically deformed, so that the annular projection 30 gets into the top wall 22' to connect the intermediate material 8' with the cam receiving plate 10 integrally.

Excessive material by the annular projection 30 flows into a cylindrical portion 24', so that the total length of the cylindrical portion 24' slightly becomes longer. In finishing, it may be cut off.

According to the method of manufacturing a tappet, it does not require accurate machining in case that the annular projection 30 of the cam receiving plate 10 and the annular projection 28 of the body 8 are separately worked and connected to each other, thereby simplifying working steps and reducing manufacturing cost. The portion on the top wall 22' strongly pressed by the annular projection 30 is concentrated, which is advantageous in strength.

FIG. 5 illustrates another embodiment of a method of manufacturing the tappet.

In this embodiment, without molding the intermediate material 8', a single step simultaneously molds a body 8 and connection of the cam receiving plate 10 with the body 8.

Figure 5A:
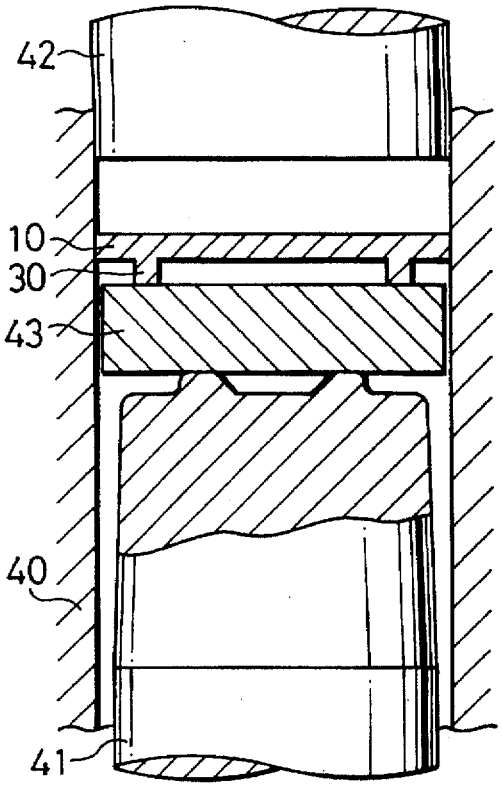
FIG. 5 shows another method according to the present invention, "A" being before pressing, "B" being after pressing.

As shown in FIG. 5(A), Al alloy cylindrical material 43 for the body 8 is put on the upper surface of a lower punch 41 which can fit with the inner surface of the body 8 in a die 40, and a cam receiving plate 10 which has an annular projection 30 is put on the upper surface.

Figure 5B:
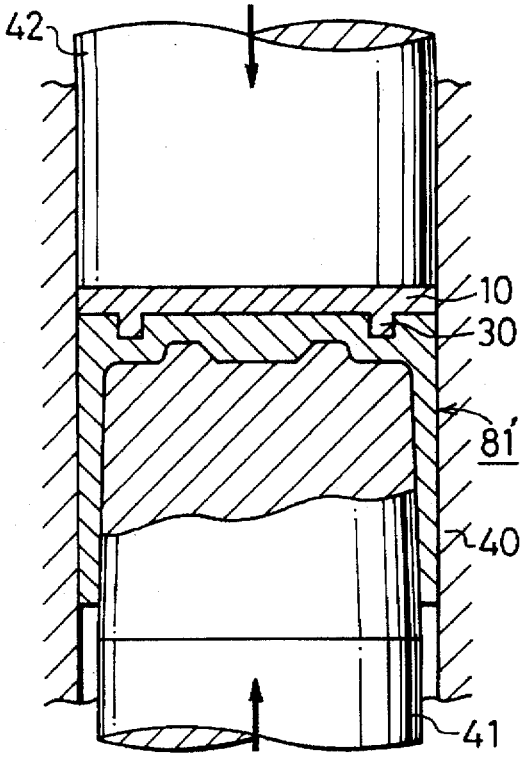
Figure 6:
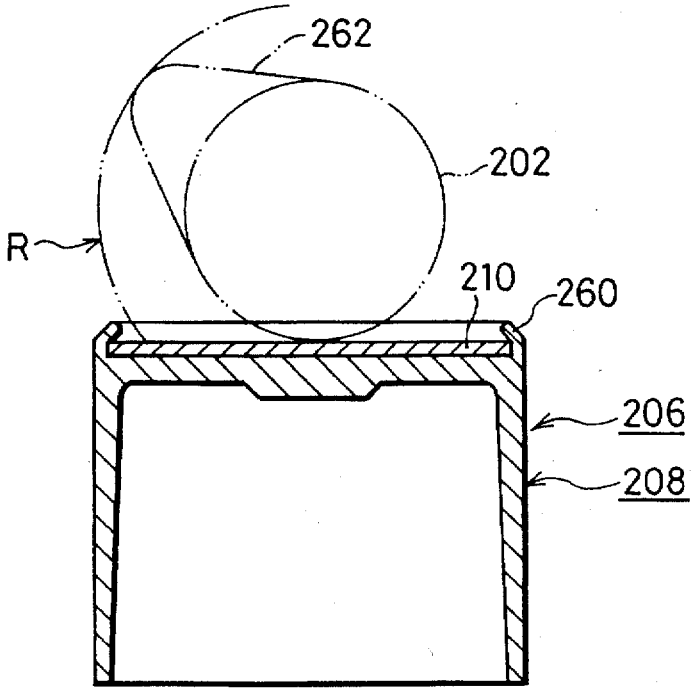
FIG.6 PRIOR ART
FIG. 6 is a central vertical sectioned front view of a conventional tappet.

Then, as shown in FIG. 5(B), the upper and lower punches 41 and 42 are moved or one of them is moved, thereby strongly pressing an original soft material 43 and a cam receiving plate 10 simultaneously. The rigid cam receiving plate 10 is not plastically deformed, and only the material 43 is plastically deformed to flow into a gap between the die 40 and the lower punch 41, thereby forming a body 8' which is roughly the same as the body 8. At the same time, an annular projection 30 of the cam receiving plate 10 gets into the material 43, so that the cam receiving plate 10 is integrally connected with the upper surface of a top wall 22'. According to the method as shown in FIG. 5, the body 8' is molded together with connection with the cam receiving plate 10, thereby further reducing cost for manufacturing compared with the embodiment in FIG. 4.

In the foregoing embodiments, the body 8 and the cam receiving plate 10 are made of Al alloy and steel respectively, but are not limited thereto. For example, the body 8 may be made of Mg alloy, and the cam receiving plate 10 may be made of wear resistant material such as cast iron. A plurality of arc-shaped projections may be provided at a certain space.

The foregoings merely relate to embodiments of the invention. Various changes and modifications may be made by person skilled in the art without departing from the scope of claims wherein:

What is claimed is:

1. A tappet in an internal combustion engine, the tappet comprising:

a cylindrical body made of light metal, an upper end of said body being closed by a top wall which has a groove on an upper surface; and a wear resistant cam receiving plate which has roughly equal diameter to said body, a lower surface of said cam receiving plate having an annular projection which is engaged in said groove of said top wall to connect said cam receiving plate with said top wall integrally, a rotary cam rotating on an upper surface of said cam receiving plate, said annular projection being formed at said lower surface of said cam receiving plate at such a position where an upper surface of said cam receiving plate is pushed by said cam that results in a maximum acceleration of said tappet.

* * * * *